US006555249B1

(12) United States Patent
Hamahara et al.

(10) Patent No.: US 6,555,249 B1
(45) Date of Patent: Apr. 29, 2003

(54) SURFACE TREATED STEEL SHEET AND METHOD FOR PRODUCTION THEREOF

(75) Inventors: Kyoko Hamahara, Chiba (JP); Hisatada Nakakoji, Chiba (JP); Kazuo Mochizuki, Chiba (JP)

(73) Assignee: Kawasaki Steel Corporation, Hyogo (JP)

( * ) Notice: Subject to any disclaimer, the term of this patent is extended or adjusted under 35 U.S.C. 154(b) by 0 days.

(21) Appl. No.: 09/856,053

(22) PCT Filed: Sep. 12, 2000

(86) PCT No.: PCT/JP00/06232

§ 371 (c)(1),
(2), (4) Date: May 17, 2001

(87) PCT Pub. No.: WO01/21853

PCT Pub. Date: Mar. 29, 2001

(30) Foreign Application Priority Data

Sep. 17, 1999 (JP) ..... 11-263458

(51) Int. Cl.[7] ..... B32B 15/18; B32B 9/04

(52) U.S. Cl. ..... 428/632; 428/639; 428/659; 428/471; 428/681; 428/704

(58) Field of Search ..... 428/632, 633, 428/628, 629, 639, 658, 659, 681, 657, 704, 699, 701, 702, 469, 470, 471, 472.3

(56) References Cited

U.S. PATENT DOCUMENTS 4,713,121 A * 12/1987 Zurilla et al. ..... 428/472.3
4,717,431 A * 1/1988 Knaster et al. ..... 428/628
4,880,476 A * 11/1989 Matsuda et al. ..... 148/253
4,895,900 A * 1/1990 Sukejima et al. ..... 525/108
5,207,840 A * 5/1993 Riesop et al. ..... 148/260
6,322,906 B1 * 11/2001 Nakakoji et al. ..... 428/659

FOREIGN PATENT DOCUMENTS

| | | |
|---|---|---|
| EP | 0 653 502 | 5/1995 |
| JP | 55-51437 | 4/1980 |
| JP | 57-177378 | 11/1982 |
| JP | 58-130282 | 8/1983 |
| JP | 59-29673 | 2/1984 |
| JP | 59-130573 | 7/1984 |
| JP | 62-33780 | 2/1987 |
| JP | 1-312081 | 12/1989 |
| JP | 3-107469 | 5/1991 |
| JP | 4-24193 | 1/1992 |
| JP | 7-138764 | 5/1995 |
| WO | 91/04354 | 4/1991 |

* cited by examiner

*Primary Examiner*—Deborah Jones
*Assistant Examiner*—Michael LaVilla
(74) *Attorney, Agent, or Firm*—Young & Thompson

(57) ABSTRACT

The coated steel sheet includes a zinc phosphate coating containing Mg on a surface of a galvanized steel sheet, and an orthophosphoric acid ester-containing coating on a surface of the zinc phosphate coating. The coated steel sheet has no coating fall-off even during a chemical conversion treatment step of an automobile producing line and has excellent perforative corrosion resistance either with no-painting or after electrodeposition painting, chemical conversion treatability and press formability.

6 Claims, 3 Drawing Sheets

10μm

10μm

10μm

10μm

10μm

SURFACE TREATED STEEL SHEET AND METHOD FOR PRODUCTION THEREOF

TECHNICAL FIELD

The present invention relates to a coated steel sheet used mainly as a steel sheet for car bodies and a method for making the same, and particularly, relates to a coated steel sheet that has excellent perforative corrosion resistance with no-painting, as well as after electrodeposition painting, chemical conversion treatability and press formability.

BACKGROUND ART

A galvanized steel sheet is broadly used to prevent the strength of a car body from deteriorating after long-term use under a corrosive environment. In Japan, as zinc alloy plating, a zinc-nickel alloy plated steel sheet and a zinc-iron alloy plated steel sheet are mainly used.

The zinc-based alloy plating can provide high corrosion resistance to a steel sheet by alloying Ni or Fe and zinc, but there are some problems with alloy plating.

For instance, although a zinc-nickel alloy plated steel sheet is made by electroplating, Ni is expensive and the cost increases thereby. A problem is also found in that Ni content has to be normally controlled in an extremely narrow range (for instance, 12±1 mass %) and the making is difficult.

On the other hand, a zinc-iron alloy plated steel sheet may be made by either electroplating or hot dipping.

However, in producing a zinc-iron alloy plated steel sheet by electroplating, as for a zinc-nickel alloy plated steel sheet, it is difficult to control a percentage content of iron in a galvanized layer within an extremely narrow range, which is so-called alloy control. Furthermore, $Fe^{2+}$ ions in plating solution are likely to be oxidized, so that plating becomes unstable and making will be difficult. Accordingly, there is a problem in that the costs will be high.

In general, a zinc-iron alloy plated steel sheet is often made by hot dipping. In making a zinc-iron alloy plated steel sheet by hot dipping, a steel sheet is kept at high temperature after molten zinc is adhered to the sheet surface, thus alloying the steel sheet and zinc. However, in this method, quality fluctuates significantly, depending on Al concentration in a galvanizing bath and the temperature and time of an alloying process. A highly advanced technology is necessary to make a uniform alloy plated layer. As a result, as expected, the costs will be high.

As indicated above, any zinc-based alloy plating has problems in that the producing is difficult and the costs will be high.

On the other hand, a galvanized steel sheet in which only zinc is plated, may be made by either electroplating or hot dipping at a low cost. However, the sheet has been rarely used for a car body. This is because corrosion resistance is insufficient only with zinc plating. Especially, when a galvanized steel sheet is exposed to a corrosive environment over a long period, the sheet is likely to have perforative corrosion and has a problem in guaranteeing the strength of a car body. Additionally, a large amount of zinc is likely to accumulate on electrodes during spot welding. The endurance of electrodes is shortened, and press formability is poor.

Normally, in producing a car body, a steel sheet or a galvanized steel sheet is welded after press forming. Furthermore, after sequentially performing a chemical conversion treatment, electrodeposition painting and spray coating, the sheet is used for a car body. It is also generally known that a lower part of a door in a car body is most likely to have perforative corrosion. This is because the lower part is folded, and water that entered through window gaps and so forth is likely to accumulate therein, so that the lower part tends to corrode faster than other parts of a car body.

Among the treatments after the press forming of a car body, the chemical conversion treatment and the electrodeposition painting may be performed even at an inner side of a door, but paint cannot be applied thereto in the following spray painting. Thus, since anti-corrosion effects cannot be expected from spray painting, perforative corrosion resistance after electrodeposition painting becomes important. Additionally, at a folded part (hem structure) at a lower part of a door which is the most severely corroded section, chemical conversion treatment solution can be spread, but electrodeposition painting cannot be performed, and the part is directly exposed to a corrosive environment. Accordingly, perforative corrosion resistance becomes important in both cases with no electrodeposition painting (no-painting) and with electrodeposition painting only (after electrodeposition painting).

In this background, an art in which a Mg-containing coating is formed on zinc plating, is disclosed as a method to improve corrosion resistance of a galvanized steel sheet. For instance, Japanese Unexamined Patent Application Publication No. 1-312081 discloses a coated metal from which a phosphate coating containing Mg at 0.1 mass % or more is formed on an electrogalvanized layer.

The coated metal in the above-noted publication from which the phosphate coating containing only Mg is formed, is effective against rust in a salt spray test. However, the metal has insufficient perforative corrosion resistance in a composite cycle corrosion test, which is often the reflection of actual corrosion of a car body.

Moreover, Japanese Unexamined Patent Application Publication No. 3-107469 discloses a material from which a phosphate coating containing Mg at 1 to 7% is formed on an electrogalvanized layer. However, even in this case, although the material prevents rust in a salt spray test, perforative corrosion resistance in a composite cycle corrosion test is insignificant since only Mg is contained in the phosphate coating.

Furthermore, Japanese Unexamined Patent Application Publication No. 7-138764 discloses a zinc-containing metal plating steel sheet which is formed with zinc phosphate composite coating containing zinc and phosphorus at the weight ratio (zinc/phosphorus) of 2.504:1 to 3.166:1, and 0.06 to 9.0 weight % of at least one metal selected from iron, cobalt, nickel, calcium, magnesium and manganese, on a surface of a zinc-containing metal plated layer. However, although this plating steel sheet has excellent high-speed press formability, its corrosion resistance was not considered, and its perforative corrosion resistance is insignificant.

Additionally, Japanese Examined Patent Application Publication No. 55-51437 discloses a method of treating a galvanized steel sheet with aqueous solution containing magnesium biphosphate and condensed phosphate or boron compound, and treating the sheet with heat at 150 to 500° C. In this method, corrosion resistance in a salt spray test improves. However, since paint adhesion under a corrosive humid environment is poor after electrodeposition painting, corrosion resistance is low and perforative corrosion resistance is insignificant.

Japanese Unexamined Patent Application Publication No. 4-24193 discloses that magnesium oxide or magnesium hydrated oxide is deposited on a galvanized steel sheet at 10 to 5000 mg/m$^2$. Even in this method, like the method mentioned above, corrosion resistance in a salt spray test improves. However, since paint adhesion under a corrosive humid environment is poor after electrodeposition painting, corrosion resistance after electrodeposition painting is low and perforative corrosion resistance is insignificant.

Japanese Unexamined Patent Application Publication No. 58-130282 discloses a method of contacting aqueous solution containing Mg at 10 to 10000 ppm, to a galvanized steel sheet after a chemical conversion treatment. Since the chemical conversion treatment is carried out over zinc plating in this method, paint adhesion improves. However, perforative corrosion resistance after electrodeposition painting and with no-painting is insignificant as ordinary Mg salts (chloride, sulfate, oxide, and so forth) are used.

Japanese Unexamined Patent Application Publication No. 59-130573 discloses a method of contacting aqueous solution of pH 2 or higher containing iron ions and magnesium ions at the total of 5 to 9000 ppm, to a galvanized steel sheet after a phosphate treatment. Since the phosphate treatment is carried out over zinc plating in this method, paint adhesion improves. However, perforative corrosion resistance after electrodeposition painting and with no-painting is insignificant since iron ions are contained in the treatment solution.

Japanese Unexamined Patent Application Publication No. 57-177378 discloses a pre-coating treatment in which aqueous solution containing an oxidation inhibitor such as phosphate or a precipitation inhibitor such as magnesium salt is adhered to a steel sheet after a phosphate coating is formed thereto, and then dried. A main component of the phosphate coating is iron phosphate, zinc phosphate, zinc-iron phosphate, calcium phosphate, and so forth. Additionally, the aqueous solution adhered thereafter is simple aqueous solution of phosphate, magnesium salt, so that perforative corrosion resistance after electrodeposition painting and with no-painting is insufficient.

Japanese examined Patent Application Publication No. 59-29673 discloses a method of coating aqueous solution which contains myo-inosital phosphate, Mg salt and so forth, and water soluble resin, to a zinc or zinc alloy plated steel sheet. Application with no-painting, or improvement of corrosion resistance in a storage period before painting is an object of this method, substituting for a zinc phosphate chemical conversion coating as a conventional painting substrate. On the other hand, in the application in which a chemical conversion treatment is carried out before painting, it is an object to easily have a coating fall off during a degreasing process and to form zinc phosphate crystals uniformly. According to the invention, a coating falls off in a chemical conversion treatment of automobile producing steps, so that corrosion resistance at parts where electrodeposition painting is not performed in the electrodeposition painting process, does not improve at all an actual perforative corrosion resistance of a car body is insignificant. Additionally, press formability as a problem of galvanization hardly improves. The corrosion resistance after painting also does not exceed that of conventional zinc phosphate coating.

The object of this invention is to provide a coated steel sheet from which a coating does not fall off, as described later, even in a chemical conversion treatment of an automobile producing line, and a sheet having excellent perforative corrosion resistance with no-painting and as well as after electrodeposition painting, chemical conversion treatability and press formability, and which is useful as a rust preventive steel sheet for a car body, and the method for making the same.

DISCLOSURE OF INVENTION

The inventors have devoted themselves to discovering the methods to solve the problems in conventional arts. Accordingly, the inventors have invented a coated steel sheet which has a zinc phosphate based coating containing Mg on the surface of a galvanized steel sheet, and moreover, has an orthophosphoric acid ester-containing coating on the surface of the zinc phosphate coating.

It is preferable that the zinc phosphate coating further contains Ni and Mn since the perforative corrosion resistance of the coated steel sheet after electrodeposition painting further improves. In this case, it is further preferable that the zinc phosphate coating contains Mg at 0.5 to 10.0 mass %, Ni at 0.1 to 2.0 mass % and Mn at 0.5 to 8.0 mass %, and that the contents of Mn and Ni satisfy the following Formula (1). Accordingly, perforative corrosion resistance after electrodeposition painting improves significantly.

$$[Ni]\times 7.6-10.9 \leqq [Mn] \leqq [Ni]\times 11.4 \quad (1)$$

wherein [Mn] is mass % of Mn, and [Ni] is mass % of Ni.

Additionally, in the above-mentioned conditions, the contents of Mg, Ni and Mn in the zinc phosphate coating, in particular, are further limited to a specific narrow range. Specifically, the above zinc phosphate coating contains Mg at 2.0 to 7.0 mass %, Ni at 0.1 to 1.4 mass % and Mn at 0.5 to 5.0 mass %, and the contents of Mn and Ni satisfy the Formula (1) mentioned above. Accordingly, both perforative corrosion resistance and press formability improve, which is more preferable. It is further preferable, in case of the coated steel sheet, that zinc phosphate in the zinc phosphate coating is granular crystals of less than 2.5 $\mu$m of the longer side since press formability particularly improves further.

It is further preferable that the orthophosphoric acid ester-containing coating additionally contains Mg since perforative corrosion resistance of any of the coated steel sheets mentioned above improves further.

Moreover, the present application also provides a method for producing a coated steel sheet in which a galvanized steel sheet is treated with zinc phosphate treatment solution containing Mg, and is subsequently coated with aqueous solution containing orthophosphoric acid ester and is then dried.

It is preferable that the aqueous solution containing orthophosphoric acid ester further contains Mg in the method. In this case, it is further preferable that the aqueous solution containing orthophosphoric acid ester contains Mg at 2 to 30 g/l and orthophosphoric acid ester at 5 to 500 g/l.

Moreover, the orthophosphoric acid ester is preferably at least one kind selected from the group consisting of triaryl phosphate, hexose monophosphate, adenylic acid, adenosine diphosphate, adenosine triphosphate, phytic acid, inosinic acid, inosine diphosphate, and inosine triphosphate in each method mentioned above.

Furthermore, Mg that is contained in the zinc phosphate treatment solution or the orthophosphoric acid ester-containing aqueous solution, is preferably supplied from at least one type selected from the group consisting of magnesium hydroxide, magnesium oxide, magnesium nitrate, magnesium silicate, magnesium borate, magnesium hydrogenphosphate, and trimagnesium phosphate in any method mentioned above.

BEST MODE FOR CARRYING OUT THE INVENTION

Figure 1:
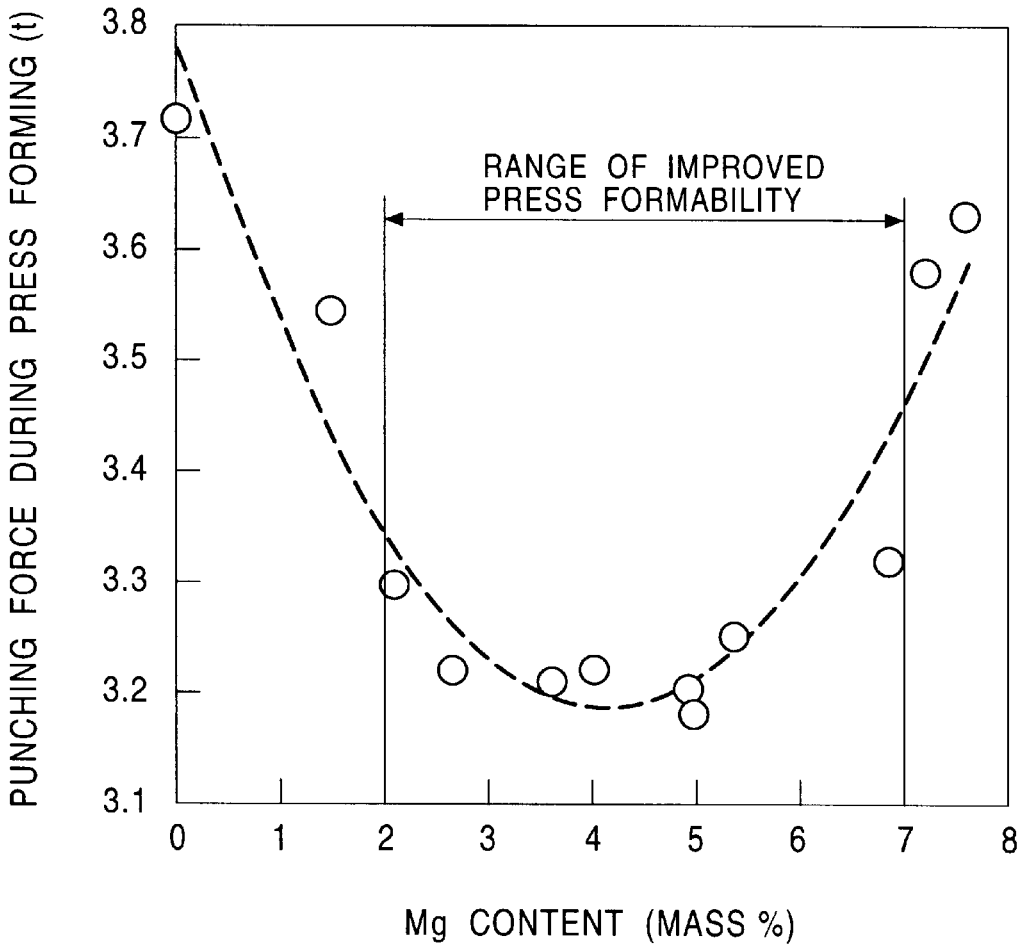
FIG. 1 is a view in which punching force during press forming on various steel sheets having different Mg contents in zinc phosphate coatings, are plotted against the Mg contents in zinc phosphate coatings.
Figure 2A:
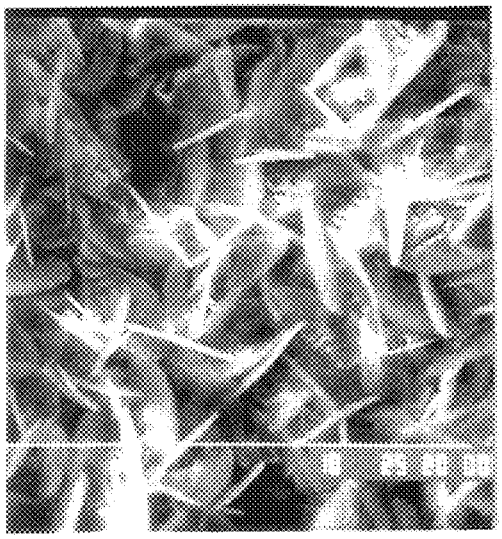
FIGS. 2(*a*) to (*d*) are image pictures when a surface of zinc phosphate coatings of four types of galvanized steel sheets which have different Mg, Ni and Mn contents in each zinc phosphate coating, is observed by SEM.
Figure 2B:
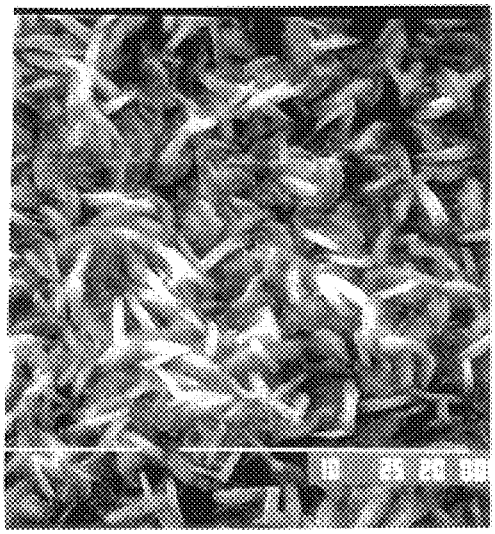
Figure 2C:
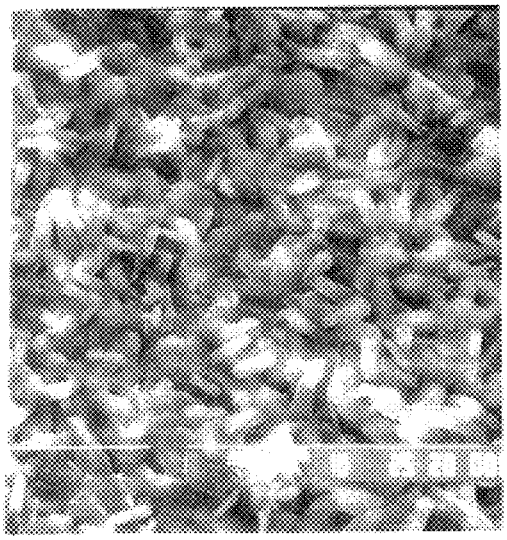
Figure 2D:
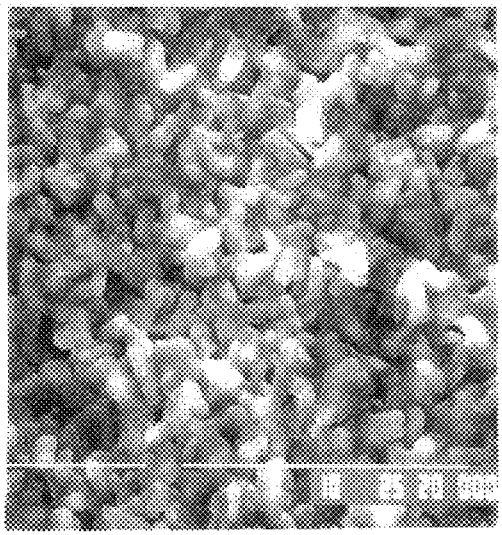

As a material for the coated steel sheet of the invention, zinc or zinc alloy plated steel sheets are used. Among them, pure zinc plating is recommended since it is economical and is used for general purposes.

A galvanized coating constituting a galvanized steel sheet may be formed by conventional electroplating or hot dipping. The coating weight of plating is not particularly limited. However, in consideration of perforative corrosion resistance, press formability and weldability, normally, the coating weight is preferably in the range of 20 to 60 g/m$^2$ per side. It is uneconomical to deposit a large amount of zinc.

In this invention, a zinc phosphate coating containing Mg is formed on a galvanized coating, and the coating containing orthophosphoric acid ester is formed thereon as a top layer. It was realized that, in this structure, a steel sheet is provided. From the steel sheet, the zinc phosphate coating does not fall off even during a chemical conversion treatment process (particularly, phosphate chemical conversion treatment process with acid treatment solution) of an automobile producing line. The steel sheet has excellent perforative corrosion resistance with no-painting and as well as after electrodeposition painting, chemical conversion treatability and press formability.

The inventors found out that sufficient perforative corrosion resistance may be obtained with no-painting and after electrodeposition painting as long as a galvanized steel sheet is initially coated with a zinc phosphate coating containing Mg. It is considered that perforative corrosion resistance at non-painted parts improves since Mg oxide becomes passive and the dissolution of zinc in a corrosive environment is delayed.

Moreover, the press formability improves due to the properties of the zinc phosphate coating to reduce resistance between metal surfaces (between galvanized surface and a die surface) and to minimize damages on the galvanized coating from friction as a cushioning body between the metal surfaces by holding lubricant. Particularly, by adding Mg to the zinc phosphate coating, superior press formability may be obtained.

Furthermore, by forming the orthophosphoric acid ester-containing coating on a surface of the zinc phosphate film, Mg in the zinc phosphate coating does not fall off even during a chemical conversion treatment process of an automobile producing line, so that perforative corrosion resistance improves.

Since being exposed to alkali solution during a degreasing treatment and acid solution during a phosphate chemical conversion treatment in the chemical conversion process of an automobile producing line, a coating having excellent alkali resistance and acid resistance has to be formed on a galvanized steel sheet. Regarding this matter, if only a zinc phosphate coating containing Mg is formed on a galvanized steel sheet, the zinc phosphate containing Mg would fall off and sufficient perforative corrosion resistance would not be obtained with no-painting or after electrodeposition painting.

However, in this invention, as in the above-noted structure, the orthophosphoric acid ester-containing coating is formed on a surface of the zinc phosphate coating, thus preventing the zinc phosphate coating from falling off. Furthermore, the orthophosphoric acid ester-containing coating also does not fall off even in a chemical conversion treatment process at an automobile producing line, and is adhered on a surface of a galvanized steel sheet. As a result, a coated steel sheet having the above-noted properties may be made.

It is unclear why the zinc phosphate coating containing Mg does not fall off during the chemical conversion treatment process by forming the orthophosphoric acid ester-containing coating. However, it is probably because divalent metal ions such as Mg, Ni, Mn and Zn in the zinc phosphate coating are prevented from eluting by cross-linking reaction of orthophosphoric acid ester itself, cross-linking reaction between orthophosphoric acid ester and the zinc phosphate containing Mg at a bottom layer, and moreover, chelation of metal ions with orthophosphoric acid ester. Furthermore, it is assumed that a coating having excellent alkali resistance and acid resistance is formed since orthophosphoric acid ester has excellent adherence to a substrate.

Moreover, as a preferable mode for carrying out the present application, it is preferable that Ni and Mn, in addition to Mg, are also contained in the zinc phosphate coating. Accordingly, perforative corrosion resistance after electrodeposition painting improves. In this case, when Mg, Ni, Mn are contained in the range of 0.5 to 10.0 mass %, 0.1 to 2.0 mass % and 0.5 to 8.0 mass %, respectively, and satisfy the formula of $[Ni]\times 7.6-10.9 \leqq [Mn] \leqq [Ni]\times 11.4$, perforative corrosion resistance after electrodeposition painting improves sharply.

Additionally, in the above-noted conditions, when Mg, Ni and Mn are limited to a narrower range of 2.0 to 7.0 mass %, 0.1 to 1.4 mass % and 0.5 to 5.0 mass %, respectively, in the zinc phosphate coating, not only perforative corrosion resistance but also press formability may improve.

The above-mentioned preferable ranges of the components in the zinc phosphate coating were found in a process that will be explained below.

In the producing steps of a car body, a body which is assembled by welding or the like after press forming is generally treated by chemical conversion, and moreover, electrodeposition painting and spray coating. However, at locations where perforative corrosion is likely to occur (for instance, inner side of a door), treatments only up to electrodeposition painting are performed, and spray painting is not carried out. Therefore, perforative corrosion resistance becomes important in the case where only the electrodeposition painting is carried out without spray painting.

When a galvanized steel sheet which was sequentially treated by chemical conversion and each coating mentioned above is exposed to a corrosive environment, moisture in the corrosive environment is condensed on a chemical conversion coating (phenomenon to have adsorbed water or bound water), and blisters are likely to form. As a result, corrosion is likely to accelerate.

Therefore, in a galvanized steel sheet for an automobile, generally speaking, this condensation is prevented and corrosion resistance after electrodeposition painting is increased by adding Ni and Mn to the chemical conversion (zinc phosphate) coating.

It is also known that corrosion resistance improves by adding Mg to zinc phosphate coating.

The inventors thought that corrosion resistance, especially perforative corrosion resistance after electrodeposition painting, might increase due to the synergistic effects of corrosion resistance of Mg and blister preventive property of Ni and Mn if Mg, Ni and Mn could be added to zinc phosphate coating; thus, the inventors carried out experiments thoroughly.

Accordingly, when Mg was added at a predetermined amount or more to a zinc phosphate coating, Ni and Mn could not be added in appropriate amounts to the coating. On the other hand, when Ni and Mn were added to a zinc phosphate coating at predetermined amounts or more, Mg could not be added in an appropriate amount to the coating. Thus, it was found that, in any case, it is practically difficult to add Mg as well as Ni, Mn in appropriate amounts.

Therefore, the inventors further experimented in order to appropriately add Mg, Ni and Mn to a zinc phosphate coating. Accordingly, the inventors successfully added Ni and Mn at amounts that can improve corrosion resistance and prevent blisters, only when Mg was within the range of 0.5 to 10.0 mass %. The inventors also discovered that perforative corrosion resistance after electrodeposition painting, in particular, improves by appropriately controlling the contents of Ni and Mn.

Specifically, in the invention of the present application, it is preferable that the zinc phosphate coating contains Mg at 0.5 to 10.0 mass %, Ni at 0.1 to 2.0 mass % and Mn at 0.5 to 8.0 mass %, and that the contents of Mn and Ni are within the range to satisfy $[Ni]\times7.6-10.9<[Mn]\leqq[Ni]\times11.4$. In other words, a Mg amount is preferably 0.5 to 10.0 mass %, and the contents of Mn and Ni are preferably within a range indicated with oblique lines in FIG. 3.

In other words, the preferable content of Mg in a zinc phosphate coating is in the range of 0.5 to 10.0 mass % so as to provide enough perforative corrosion resistance and to demonstrate blister preventive effects of Ni and Mn.

Figure 3:
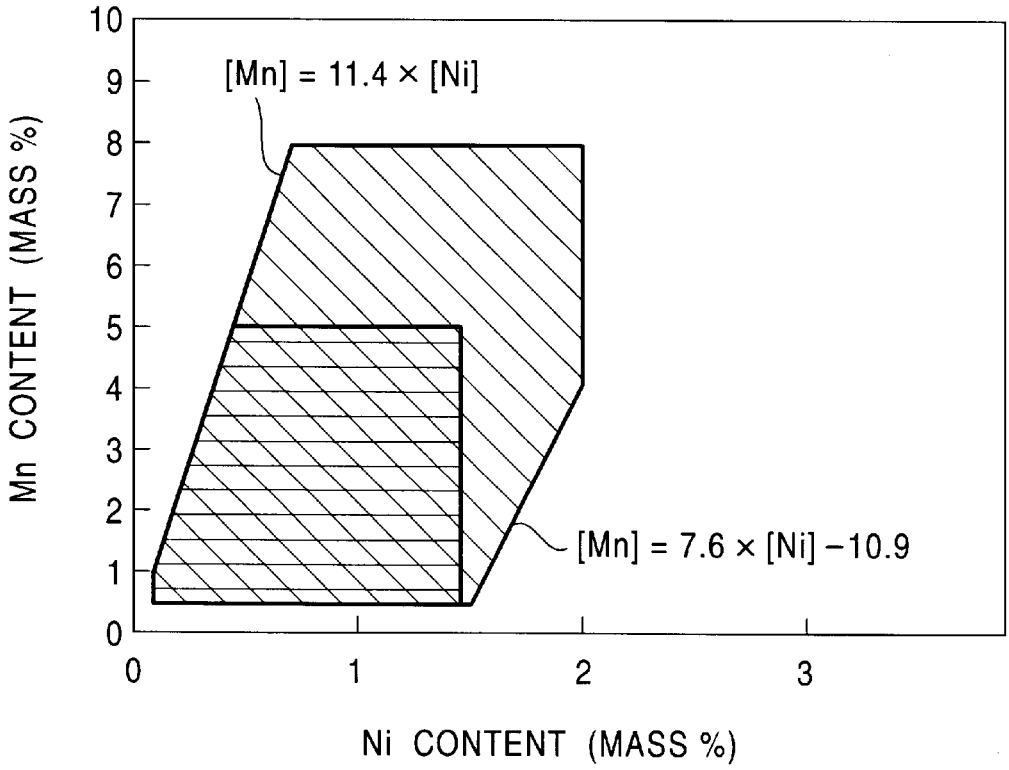
FIG. 3 is a view to explain preferable ranges and more preferable ranges of Mn-and Ni contents in a zinc phosphate coating formed on a galvanized steel sheet of the invention.

Moreover, it is preferable that the zinc phosphate coating of the present application contains Ni at 0.1 to 2.0 mass % and Mn at 0.5 to 8.0 mass %, and that both satisfy the Formula, $[Ni]\times7.6-10.9\leqq[Mn]\leqq[Ni]\times11.4$. Specifically, the range shown in FIG. 3 is considered preferable for the contents of Ni and Mn because Mg can be easily added to a zinc phosphate coating at 0.5 mass % or more as a lower limit of the above-noted range. Additionally, sufficient perforative corrosion resistance may be achieved.

Furthermore, when Mn mass % is at $\{[Ni]\times7.6-10.9\}$ or more and $\{[Ni]\times11.4\}$ or less, Mg can be easily added to the zinc phosphate coating at 0.5 mass % or more and perforative corrosion resistance may become sufficient.

Additionally, in order to improve press formability in addition to perforative corrosion resistance in the present invention, it is preferable that the zinc phosphate coating contains Mg at the limited range of 2.0 to 7.0 mass %, Ni at 0.1 to 1.4 mass %, and Mn at 0.5 to 5.0 mass %. Additionally, the contents of Mn and Ni are preferably limited to the range to satisfy $[Ni]\times7.6-10.9\leqq[Mn]\leqq[Ni]\times11.4$. Specifically, it is preferable that a Mg content is limited to 2.0 to 7.0 mass %, and that Ni and Mn contents are restricted to a range where the oblique-line range overlaps a lateral-line range in FIG. 3.

A more preferable content of Mg in a zinc phosphate coating is in the range of 2.0 to 7.0 mass % because zinc phosphate is likely to be granular crystals and the long side can be less than 2.5 μm and small. Accordingly, press formability improves significantly. The reasons thereof are unclear. However, it is considered that sliding frictional resistance at a die is small during press forming if zinc phosphate crystals are granular and fine.

Moreover, when the Mg content is less than 2.0 mass %, zinc phosphate crystals are in a scale shape (see FIGS. 2(*a*), (*b*)) and the crystals are 2.5 μm or longer in size (longer side). Thus, the improvement of press formability becomes unremarkable. When the Mg content exceeds 7.0 mass %, zinc phosphate crystals are fragile and the improvement of press formability becomes unremarkable The inventors tested various galvanized steel sheets having different Mg contents in zinc phosphate coatings, and evaluated press formability. Specifically, the galvanized steel sheets were punched out in a blank diameter of 100 mm, and press forming was performed at a punch diameter of 50 mm ϕ, die diameter of 52 mm ϕ, blank holding pressure of 1 ton (9806N), and punch speed of 120 mm/min. The results are shown in FIG. 1. The vertical axis is a punching force during press forming (t), and the horizontal axis is a Mg content (mass %) in a zinc phosphate coating. Smaller punching force indicates better press formability.

Moreover, FIG. 2 shows SEM image pictures of a surface of zinc phosphate coatings of four types of galvanized steel sheets having different Mg contents in the zinc phosphate coatings. In FIG. 2(*a*), a Mg content is 0 mass %; a Ni content is 1.3 mass %; a Mn content is 1.9 mass %. In FIG. 2(*b*), a Mg content is 1.1 mass %; a Ni content is 1.3 mass %; a Mn content is 1.6 mass %. In FIG. 2(*c*), a Mg content is 2.1 mass %; a Ni content is 0.7 mass %; a Mn content is 1.3 mass %. In FIG. 2(*d*), a Mg content is 4.0 mass %; a Ni content is 0.3 mass %; a Mn content is 1.0 mass %.

When the Mg content is limited to the range of 2.0 to 7.0 mass % in accordance with FIG. 1 and FIG. 2, it is found that zinc phosphate crystals become less than 2.5 μm in size (longer side) (see FIGS. 2(*c*), (*d*)), and that press formability improves sharply.

Figure 4:
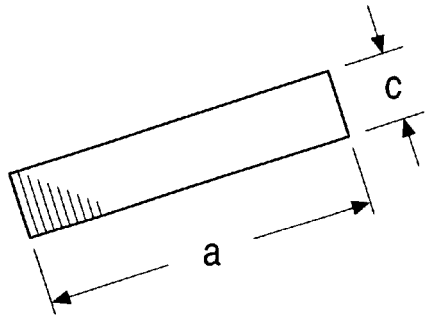
FIG. 4 is a view so as to explain granular zinc phosphate crystals formed on a galvanized steel sheet of the invention.

The granular shape mentioned herein indicates that a ratio of shorter side c/longer side a exceeds 0.2 when one crystal observed by a SEM image picture is expressed as in FIG. 4.

Therefore, when press formability has to be improved further, the Mg content is preferably in the range of 2.0 to 7.0 mass %.

In this case, when a Ni content is less than 0.1 mass % or a Mn content is less than 0.5 mass % in a zinc phosphate coating, blisters under a corrosive environment sometimes become worse, which is not preferable in consideration of perforative corrosion resistance. On the other hand, when a Ni content is more than 1.4 mass % or a Mn content exceeds 5.0 mass %, it will be difficult to add Mg at 2.0 mass % or more to a zinc phosphate coating. Accordingly, zinc phosphate crystals do not become fine and are often in a scale shape with a longer side of 2.5 μm or longer, so that press formability hardly improves.

The coating weight of a zinc phosphate coating is preferably in the range of 0.5 to 3.0 $g/m^2$ in the invention of the present invention. When the coating weight is 0.5 $g/m^2$ or more, perforative corrosion resistance after electrodeposition painting and press formability may improve significantly. Additionally, adherence to a coating containing Mg and orthophosphoric acid ester, becomes important, and the coating containing Mg and orthophosphoric acid ester does not dissolve in a chemical conversion treatment process for an automobile. On the other hand, when the coating weight is 3.0 g/m$^2$ or less, a coating is formed in a short period and the cost is low. Additionally, frictional resistance at a surface becomes small, and press formability improves. In consideration of perforative corrosion resistance after electrodeposition painting and press formability, it is preferable if the coating weight of a zinc phosphate coating is in the range of 0.5 to 2.0 g/m$^2$.

Moreover, by adding Mg to the coating containing orthophosphoric acid ester, perforative corrosion resistance may further improve. In this case, it is preferable that Mg is 0.01 to 0.50 g/m$^2$ in Mg conversion, and that the coating weight of an entire coating is 0.1 to 2.0 g/m$^2$. Moreover, when the coating containing orthophosphoric acid ester does not contain Mg, the coating weight per side of the coating is preferably 0.01 to 2.0 g/m$^2$.

The coating weight of the orthophosphoric acid ester-containing coating containing Mg is limited, because perforative corrosion resistance is fully obtained at 0.01 g/m$^2$ or more in Mg conversion content even without painting. On the other hand, even when the coating weight is more than 0.50 g/m$^2$in Mg conversion, the cost will only increase due to the excessive use of Mg and so forth, and perforative corrosion resistance with no-painting will not improve further. When the coating weight of an entire coating is 0.1 g/m$^2$ or more, cross-linking by orthophosphoric acid ester becomes insufficient and Mg does not fall off during a chemical conversion treatment process of an automobile producing line. On the other hand, even if the coating weight exceeds 2.0 g/m$^2$, the effects of preventing Mg from falling off by cross-linking would not improve further and the cost would increase.

Moreover, the coating weight of the orthophosphoric acid ester-containing coating that contains no Mg, is limited. This is because the coating does not include metal ions (Mg), and the coating may be bonded (chelated) only to metal (Mg, Ni, Mn, Zn) ions in the zinc phosphate coating at the bottom and can prevent the elution of the metal ions even with a small coating weight. Thus, 0.01 g/m$^2$ or more is sufficient. Additionally, an upper limit is given to prevent a cost increase as in the case when Mg is added.

Subsequently, the method for producing the coated steel sheet of this invention will be explained.

First, a galvanized coating is formed on a steel sheet surface. The galvanized coating may be formed by conventional electroplating or hot dipping. The galvanized coating is generally mixed with Sn, Ni, Fe, Al and so forth as inevitable impurities. Thus, in the invention, the galvanized coating into which these impurities are inevitably mixed, is also targeted. In this case, it is preferable that each content of the inevitable impurities in the galvanized coating is 1 mass % or less.

After the galvanized coating is formed, a zinc phosphate treatment is carried out with zinc phosphate treatment solution containing Mg to form a zinc phosphate coating on the galvanized coating. The method of forming the zinc phosphate coating may include a method of dipping a galvanized steel sheet into treatment solution or a method of spraying the treatment solution onto the steel sheet under zinc phosphate treatment conditions shown in, for instance, Table 1. In any zinc phosphate treatment, it is preferable to condition a surface before the treatment.

After the zinc phosphate coating is formed, an orthophosphoric acid ester-containing coating is also formed thereon. The orthophosphoric acid ester-containing coating is formed by coating and then drying aqueous solution containing orthophosphoric acid ester. Cross-linking to a Mg-containing zinc phosphate coating as a bottom layer, and cross-linking of orthophosphoric acid ester itself are formed thereby. The orthophosphoric acid ester for use in the present invention is preferably at least one kind selected from the group consisting of triaryl phosphate such as triphenyl phosphate and tricresyl phosphate, hexose monophosphate, adenylic acid, adenosine diphosphate, adenosine triphosphate, phytic acid, inosinic acid, inosine diphosphate and inosine triphosphate. Particularly, when phytic acid is used, the proportion ratio of orthophosphoric acid ester ions in one molecule is high and the cross-linking property of the formed coating is extremely high. Thus, the coating hardly falls off during a chemical conversion treatment process, and perforative corrosion resistance at non-painted parts improves significantly.

The orthophosphoric acid ester is coated in the form of aqueous solution by an ordinary method such as dipping, spraying, roll coating and bar coating. It is preferable to dry the coating under the condition in which steel sheet temperature is at 50 to 250° C. In this drying operation, the coating may be dried by increasing temperature to predetermined temperature after aqueous solution is coated, or the aqueous solution may be coated after raising the temperature of a steel sheet to predetermined temperature in advance.

Furthermore, when Mg is added to the orthophosphoric acid ester-containing coating, it is preferable to add more Mg to orthophosphoric acid ester aqueous solution. In this case, a Mg amount in aqueous solution is preferably 2 to 30 g/l in Mg conversion, and the amount of orthophosphoric acid ester is preferably 5 to 500 g/l. When the Mg amount in aqueous solution is 2 g/l or more in Mg conversion, the coating weight of Mg increases and perforative corrosion resistance becomes sufficient. On the other hand, when the Mg amount exceeds 30 g/l in Mg conversion, the coating weight of Mg becomes so large that precipitation is found in aqueous solution, which is uneconomical. Moreover, when the amount of orthophosphoric acid ester is 5 g/l or more, the coating is well cross-linked. Accordingly, the coating does not fall off during a chemical conversion treatment process of an automobile making line, and has excellent alkali resistance and acid resistance. On the other hand, the amount of orthophosphoric acid ester is 500 g/l or less because cross-linking effects are unlikely to improve even by increasing the amount, and the cost increases.

In the invention of the present application, Mg which is contained in the zinc phosphate treatment solution or the orthophosphoric acid ester-containing aqueous solution, is supplied from at least one kind selected from the group consisting of magnesium hydroxide, magnesium oxide, magnesium nitrate, magnesium silicate, magnesium borate, magnesium hydrogenphosphate, and trimagnesium phosphate.

The above-noted description merely shows one example of the mode for carrying out the invention, and various changes may be added in claims.

EXAMPLES

Subsequently, the examples of the invention will be explained.

A zinc or zinc alloy plated coating was formed on a cold rolled steel sheet by a plating method and at a coating weight shown in Table 2. Then, after the surface of the coating was conditioned, a zinc phosphate coating was formed from zinc phosphate treatment solution containing Mg, Ni, Mn at various concentrations shown in Table 1. Subsequently, on the surface of the zinc phosphate coating, orthophosphoric acid ester aqueous solution or the aqueous solution to which Mg is added thereto, was coated by a coating method shown in Table 3. The coating was dried by baking with an electric furnace to set the maximum temperature of the steel sheet at 150° C., thus forming a coating containing orthophosphoric acid ester. Conditions of forming the orthophosphoric acid ester-containing coating are also summarized in Table 3.

Each test shown below was carried out to coated steel sheets obtained thereby, and various characteristics were evaluated.

Perforative Corrosion Resistance (Corrosion Resistance without Painting)

Each coated steel sheet was dipped in phosphate treatment solution SD2500 (made by Nippon Paint Co., Ltd.) after carrying out ordinary alkali degreasing and then surface conditioning in accordance with producing steps of a car body. After the chemical conversion treatment, a sample was baked at 165° C. for 25 minutes. Subsequently, a red rust area was checked after the following cycle was repeated once a day for ten days. The results were evaluated with "◎" for a less than 10% red rust area, "○" for a 10% or more and less than 50% red rust area, "Δ" for a 50% or more and less than 100% red rust area, and, "×" for a 100% red rust area.

Salt spraying (35° C., 6 h)→Drying (50° C., 3 h)→Humidifying (50° C., 14 h)→Setting (35° C., 1 h)

Perforative Corrosion Resistance (Corrosion Resistance after Electrodeposition Painting) Each coated steel sheet was dipped in phosphate treatment solution SD2500 (made by Nippon Paint Co., Ltd.) after carrying out ordinary alkali degreasing and then surface conditioning in accordance with producing steps of a car body. After the chemical conversion treatment, electrodeposition painting was carried out at 250 V of electrodeposition voltage by using V-20 electrodeposition paint made by Nippon Paint Co., Ltd. (bath temperature: 28 to 30° C.). Then, the painting was baked at 165° C. for twenty minutes, thus forming an electrodeposition paint film (film thickness: 10 μm). After the electrodeposition painting, a sample was cross-cut by a knife. Then, a composition cycle corrosion test shown below was repeated once a day for 100 days, and perforative corrosion resistance after electrodeposition painting was evaluated by measuring the maximum corrosion depth.

Salt spraying (35° C., 6 h)→Drying (50° C., 3 h)→Humidifying (50° C., 14 h)→Setting (35° C., 1 h)

Mg Fixing Ratio during Chemical Conversion Treatment Process

Mg amounts before and after the above-noted chemical conversion treatment were measured by fluorescent X-rays. The ratio (%) of a Mg amount after the chemical conversion treatment relative to a Mg amount before the chemical conversion treatment was determined as a Mg fixing ratio. The results were evaluated with "○" for a 80% or higher Mg fixing ratio, "Δ" for a 50% or higher and less than 80% Mg fixing ratio, and "×" for a less than 50% Mg fixing ratio.

Press Formability

Each coated steel sheet mentioned above was punched out in a blank diameter of 100 mm, and swift cup forming was performed at the punch diameter of 50 mm ϕ, die diameter of 52 mm ϕ, blank holding pressure of 1 ton (9806N), and punch speed of 120 mm/min. Damage level on a worked surface (cup side surface) was visually judged. The results were evaluated with "○" for a less than 5% damaged area of the coating surface, "Δ" for a 5% or more and less than 30% damaged area of the coating, and "×" for a 30% or more damaged area of the coating. Additionally, smaller punching force indicates more preferable press formability. In the invention, when the punching force is 3.4 t (33342N) or less, press formability is particularly excellent.

Clearly shown in the evaluation results of Table 3, the coated steel sheet of the invention has little coating fall-off in a chemical conversion treatment process in comparison with a conventional material, and has excellent perforative corrosion resistance in any case with no-painting or after electrodeposition painting.

Additionally, it is found that chemical conversion treatability (Mg fixing ratios before and after chemical conversion treatments) and press formability are both preferable.

TABLE 1

| Conditions of Zinc Phosphate Treatment Solution | |
|---|---|
| $PO_4^{3-}$ | 5 to 30 g/L |
| $Zn^{2+}$ | 0.5 to 3.0 g/L |
| $Ni^{2+}$ | 0.1 to 10.0 g/L |
| $Mn^{2+}$ | 0.3 to 10.0 g/L |
| $Mg^{2+}$ | 3 to 50 g/L |
| $NO_3^-$ | 1 to 150 g/L |
| All Fluorine | 0.1 to 0.8 g/L |
| Treatment Temperature | 40 to 60° C. |

TABLE 2a

| | Galvanized Coating | | Zinc Phosphate Coating | | | | | | | |
|---|---|---|---|---|---|---|---|---|---|---|
| | | Coating Weight | Coating Weight | Ni | (Ni × 7.6 ) | Mn | | Mg | Zinc Phosphate Crystals | |
| | Manufacture | (g/m²) | (g/m²) | (mass %) | −10.9 | (mass %) | Ni × 11.4 | (mass %) | Shape | Size (μm) |
| Example 1 | a | 23 | 1.5 | 0.8 | −4.82 | 3.2 | 9.12 | 3.5 | Granular Shape | 1.3 |
| Example 2 | a | 30 | 2.0 | 1.2 | −1.78 | 3.6 | 13.68 | 3.8 | Granular Shape | 1.3 |
| Example 3 | b | 45 | 1.8 | 1.9 | 3.54 | 7.9 | 21.66 | 0.6 | Scake Shape | 2.8 |
| Example 4 | b | 58 | 2.2 | 0.6 | −6.34 | 6.8 | 6.84 | 2.7 | Granular Shape | 2.2 |
| Example 5 | a | 30 | 0.5 | 0.7 | −5.58 | 3.1 | 7.98 | 9.5 | Granular Shape | 1.1 |
| Example 6 | b | 45 | 2.9 | 1.0 | −3.30 | 4.5 | 11.40 | 4.6 | Granular Shape | 1.2 |
| Example 7 | a | 23 | 0.7 | 0.6 | −6.34 | 4.0 | 6.84 | 0.6 | Scake Shape | 2.9 |
| Example 8 | b | 45 | 2.8 | 1.8 | 2.78 | 5.0 | 20.52 | 5.5 | Granular Shape | 1.2 |
| Example 9 | a | 30 | 1.0 | 1.5 | 0.50 | 3.5 | 17.10 | 3.8 | Granular Shape | 1.3 |
| Example 10 | b | 58 | 1.2 | 2.0 | 4.30 | 5.0 | 22.80 | 2.7 | Granular Shape | 2.2 |

TABLE 2a-continued

| | Galvanized Coating | | Zinc Phosphate Coating | | | | | | | |
|---|---|---|---|---|---|---|---|---|---|---|
| | | Coating Weight | Coating Weight | Ni | (Ni × 7.6 ) | Mn | | Mg | Zinc Phosphate Crystals | |
| | Manufacture | (g/m$^2$) | (g/m$^2$) | (mass %) | −10.9 | (mass %) | Ni × 11.4 | (mass %) | Shape | Size (μm) |
| Example 11 | a | 30 | 1.5 | 0.05 | −10.52 | 8.5 | 0.57 | 3.8 | Granular Shape | 1.3 |
| Example 12 | b | 58 | 2.2 | 1.0 | −3.30 | 1.0 | 11.40 | 5.5 | Granular Shape | 1.2 |
| Example 13 | a | 30 | 2.0 | 0 | −10.90 | 8.2 | 0 | 0.2 | Scake Shape | 3.1 |
| Example 14 | a | 30 | 1.0 | 0.3 | −8.62 | 1.0 | 3.42 | 2.0 | Granular Shape | 2.4 |
| Example 15 | a | 23 | 1.5 | 0.8 | −4.82 | 3.2 | 9.14 | 3.5 | Granular Shape | 1.3 |
| Example 16 | a | 30 | 2.0 | 1.2 | −1.78 | 3.6 | 13.68 | 3.8 | Granular Shape | 1.3 |
| Example 17 | b | 45 | 1.8 | 1.9 | 3.54 | 7.9 | 21.66 | 0.6 | Scake Shape | 2.8 |
| Example 18 | b | 58 | 2.2 | 0.12 | −9.99 | 1.2 | 6.84 | 2.7 | Granular Shape | 2.2 |
| Example 19 | a | 30 | 0.5 | 0.7 | −5.58 | 3.1 | 7.98 | 9.5 | Granular Shape | 1.1 |
| Example 20 | b | 45 | 2.9 | 1.0 | −3.30 | 4.5 | 11.40 | 4.6 | Granular Shape | 1.2 |
| Example 21 | a | 23 | 0.7 | 0.12 | −9.99 | 0.6 | 6.84 | 0.6 | Scake Shape | 2.9 |
| Example 22 | b | 45 | 2.8 | 1.8 | 2.78 | 5.0 | 20.52 | 5.5 | Granular Shape | 1.2 |

TABLE 2b

| | Galvanized Coating | | Zinc Phosphate Coating | | | | | | | |
|---|---|---|---|---|---|---|---|---|---|---|
| | | Coating Weight | Coating Weight | Ni | (Ni × 7.6 ) | Mn | | Mg | Zinc Phosphate Crystals | |
| | Manufacture | (g/m$^2$) | (g/m$^2$) | (mass %) | −10.9 | (mass %) | Ni × 11.4 | (mass %) | Shape | Size (μm) |
| Example 23 | a | 30 | 1.0 | 1.5 | 0.50 | 3.5 | 17.10 | 3.8 | Granular Shape | 1.3 |
| Example 24 | b | 58 | 1.2 | 2.0 | 4.30 | 5.0 | 22.80 | 2.7 | Granular Shape | 2.2 |
| Example 25 | a | 30 | 1.5 | 0.4 | −7.86 | 8.5 | 4.56 | 3.8 | Granular Shape | 1.3 |
| Example 26 | b | 58 | 2.2 | 1.0 | −3.30 | 1.0 | 11.40 | 5.5 | Granular Shape | 1.2 |
| Example 27 | a | 30 | 2.0 | 0 | −10.90 | 8.2 | 0 | 0.2 | Scale Shape | 3.1 |
| Example 28 | a | 30 | 1.0 | 0.3 | −8.62 | 1.0 | 3.42 | 2.0 | Granular Shape | 2.4 |
| Example 29 | a | 35 | 1.0 | 0 | −10.90 | 0 | 0 | 4.8 | Granular Shape | 1.2 |
| Comparative Example 1 | b | 45 | 1.5 | 0.8 | −4.82 | 3.2 | 9.12 | 0 | Scale Shape | 2.9 |
| Comparative Example 2 | b | 45 | 1.8 | 1.7 | 2.02 | 1.9 | 19.38 | 0 | Scale Shape | 3.8 |
| Comparative Example 3 | c | 45 | | | | | None | | | |
| Comparative Example 4 | a | 30 | | | | | None | | | |
| Comparative Example 5 | b | 58 | | | | | None | | | |
| Comparative Example 6 | a | 30 | | | | | None | | | |
| Comparative Example 7 | b | 58 | 2.2 | 0.6 | −6.34 | 6.8 | 6.84 | 2.7 | Granular Shape | 2.2 |
| Comparative Example 8 | b | 45 | 1.5 | 0.8 | −4.82 | 3.2 | 9.12 | 0 | Scale Shape | 2.9 |
| Comparative Example 9 | b | 45 | i.8 | 1.7 | 2.02 | 1.9 | 19.38 | 0 | Scale Shape | 3.8 |
| Comparative Example 10 | a | 30 | 1.0 | 1.5 | 0.50 | 3.5 | 17.10 | 2.0 | Granular Shape | 2.3 |

*Manufacture a: Electrogalvanizing Method, b: Hot-dip galvanizing Method, c: Hot-dip galvannealing Method (Zinc:Iron = 90:10 wt %)

TABLE 3a

| | Orthophosphoric Acid Ester-Containing Coating | | | | | | | Performance Evaluation | | | | |
|---|---|---|---|---|---|---|---|---|---|---|---|---|
| | Conditions of Coating Formation | | | | | Coating Weight | | Perforative Corrosion Resistance | | | | |
| | Mg | | Orthophosphoric Acid Ester | | | | Total | With Electro- | Without | | Press Formability | |
| | Supply Source*1 | Concentration (g/l) | Type*2 | Concentration (g/l) | Coating Method | Mg ($g/m^2$) | Coating Amount ($g/m^2$) | deposition painting (mm) | Electro-deposition painting | Mg Fixing Ratio | Damage Level | Punching Force (N) |
| Example | | | | | | | | | | | | |
| 1 | — | — | 1 | 0.2 | Bar Coating | — | 0.005 | 0.12 | Δ | Δ | ○ | 32165 |
| 2 | — | — | 2 | 50 | Roll Coating | — | 0.21 | 0.10 | ○ | ○ | ○ | 31185 |
| 3 | — | — | 2 | 50 | Roll Coating*3 | — | 0.21 | 0.15 | ○ | ○ | ○ | 34127 |
| 4 | — | — | 2 | 100 | Spraying*4 | — | 0.51 | 0.18 | ◎ | ○ | ○ | 32460 |
| 5 | — | — | 2 | 10 | Dipping*5 | — | 0.15 | 0.05 | ○ | ○ | ○ | 31571 |
| 6 | — | — | 2 | 0.2 | Spraying | — | 0.02 | 0.10 | ○ | ○ | ○ | 30890 |
| 7 | — | — | 1 | 1 | Spraying | — | 0.12 | 0.18 | ○ | ○ | ○ | 33538 |
| 8 | — | — | 2 | 5 | Spraying | — | 0.11 | 0.06 | ○ | ○ | ○ | 30989 |
| 9 | — | — | 2 + 5 | 5 | Roll Coating | — | 0.05 | 0.05 | ○ | ○ | ○ | 31871 |
| 10 | — | — | 1 + 3 | 5 | Roll Coating | — | 0.08 | 0.10 | ◎ | ○ | ○ | 32165 |
| 11 | — | — | 1 | 2 | Bar Coating | — | 0.28 | 0.40 | Δ | ○ | ○ | 31185 |
| 12 | — | — | 2 | 2 | Bar Coating | — | 0.31 | 0.42 | ○ | ○ | ○ | 31871 |
| 13 | — | — | 3 | 200 | Bar Coating | — | 2.00 | 0.40 | Δ | ○ | ○ | 34421 |
| 14 | — | — | 4 | 80 | Bar Coating | — | 1.50 | 0.31 | ○ | ○ | ○ | 32656 |
| 15 | A | 1 | 1 | 2 | Bar Coating | 0.01 | 0.01 | 0.12 | Δ | Δ | Δ | 31577 |

TABLE 3b

| | Orthophosphoric Acid Ester-Containing Coating | | | | | | | Performance Evaluation | | | | |
|---|---|---|---|---|---|---|---|---|---|---|---|---|
| | Conditions of Coating Formation | | | | | Coating Weight | | Perforative Corrosion Resistance | | | | |
| | Mg | | Orthophosphoric Acid Ester | | | | Total | With Electro- | Without | | Press Formability | |
| | Supply Source*1 | Concentration (g/l) | Type*2 | Concentration (g/l) | Coating Method | Mg ($g/m^2$) | Coating Amount ($g/m^2$) | deposition painting (mm) | Electro-deposition painting | Mg Fixing Ratio | Damage Level | Punching Force (N) |
| Example | | | | | | | | | | | | |
| 16 | B | 15 | 2 | 400 | Bar Coating | 0.17 | 1.20 | 0.10 | ○ | ○ | ○ | 31381 |
| 17 | C | 8 | 3 | 50 | Bar Coating | 0.11 | 0.15 | 0.15 | ○ | ○ | Δ | 34519 |
| 18 | D | 3 | 4 | 30 | Bar Coating | 0.06 | 0.20 | 0.18 | ◎ | ○ | ○ | 31185 |
| 19 | E | 28 | 5 | 100 | Roll Coating | 0.40 | 0.55 | 0.05 | ◎ | ○ | ○ | 32460 |
| 20 | D | 18 | 2 | 30 | Roll Coating | 0.22 | 0.31 | 0.10 | ◎ | ○ | ○ | 32166 |
| 21 | B + D | B:5, D:5 | 1 | 50 | Roll Coating | 0.10 | 0.10 | 0.18 | ○ | ○ | Δ | 34323 |
| 22 | B + C | B:3, C:2 | 2 | 40 | Roll Coating | 0.03 | 0.15 | 0.06 | ○ | ○ | ○ | 30891 |
| 23 | B | 10 | 2 + 5 | 20 + 20 | Bar Coating | 0.40 | 0.80 | 0.05 | ◎ | ○ | ○ | 30597 |
| 24 | C | 15 | 1 + 3 | 30 ± 5 | Bar Coating | 0.30 | 0.20 | 0.10 | ◎ | ○ | ○ | 31872 |
| 25 | D | 3 | 4 | 100 | Bar Coating | 0.06 | 0.42 | 0.40 | ○ | ○ | ○ | 31185 |
| 26 | D | 7 | 2 | 80 | Spraying | 0.20 | 1.00 | 0.42 | ◎ | ○ | ○ | 30891 |
| 27 | A | 12 | 5 | 30 | Spraying | 0.33 | 0.60 | 0.44 | ◎ | ○ | Δ | 35500 |
| 28 | A | 23 | 1 | 150 | Spraying | 0.38 | 1.20 | 0.31 | ◎ | ○ | ○ | 33343 |
| 29 | C | 10 | 2 | 50 | Spraying | 0.38 | 0.31 | 0.40 | ◎ | ○ | ○ | 32166 |

TABLE 3c

| | Orthophosphoric Acid Ester-Containing Coating | | | | | | | Performance Evaluation | | | | |
|---|---|---|---|---|---|---|---|---|---|---|---|---|
| | Conditions of Coating Formation | | | | | Coating Weight | | Perforative Corrosion Resistance | | | Press Formability | |
| | Mg | | Orthophosphoric Acid Ester | | | | Total | With Electro- | Without | | | |
| | Supply Source*1 | Concentration (g/l) | Type*2 | Concentration (g/l) | Coating Method | Mg (g/m$^2$) | Coating Amount (g/m$^2$) | deposition painting (mm) | Electro-deposition painting | Mg Fixing Ratio | Damage Level | Punching Force (N) |
| Comparative Example | | | | | | | | | | | | |
| 1 | — | — | 5 | 50 | Bar Coating | — | 0.48 | 0.55 | × | — | Δ | 35108 |
| 2 | — | — | 2 | 0.5 | Bar Coating | — | 0.01 | 0.53 | × | — | Δ | 34617 |
| 3 | | | | None | | | | 0.58 | × | — | × | 35009 |
| 4 | | | | None | | | | 0.58 | × | — | ○ | 36873 |
| 5 | — | — | 1 | 2 | Roll Coating | — | 0.02 | 0.52 | Δ | — | × | 36088 |
| 6 | — | — | 2 | 10 | Roll Coating | — | 0.28 | 0.52 | × | — | ○ | 36873 |
| 7 | — | — | | | None | | | 0.52 | Δ | × | Δ | 34519 |
| 8 | C | 28 | 5 | 100 | Bar Coating | 0.48 | 0.13 | 0.55 | ○ | × | Δ | 34617 |
| 9 | D | 5 | 2 | 10 | Bar Coating | 0.02 | 0.02 | 0.53 | Δ | × | Δ | 36088 |
| 10 | | | | None | | | | 0.12 | × | × | ○ | 32361 |

*1Mg Supply Source A: Magnesium oxide, B: Magnesium hydroxide, C: Magnesium silicate, D: Magnesium hydrogenphosphate, E: Magnesium nitrate
*2Orthophosphoric acid ester 1: Inosine-5'-monophosphate, 2: Phytic acid, 3: Triphenyl phosphate, 4: Hexose monophosphate, 5: Tricresyl phosphate
*3Adjusted to pH 3.0 by adding NaOH.
*4Adjusted to pH 3.0 by adding NaOH.
*5Adjusted to pH 2.0 by adding $Mg(OH)_2$.

INDUSTRIAL APPLICABILITY

The invention has made it possible to provide a coated steel sheet from which a coating does not fall off in a chemical conversion treatment step of an automobile producing line, whereby the sheet has excellent perforative corrosion resistance with no-painting as well as after electrodeposition painting, chemical conversion treatability and press formability, and which is mainly useful as a steel sheet for a car body.

What is claimed is:

1. A coated steel sheet having a zinc phosphate coating containing Mg on a surface of a galvanized steel sheet, and a coating consisting essentially of an orthophosphoric acid ester on a surface of the zinc phosphate coating.

2. The coated steel sheet according to claim 1, wherein the zinc phosphate coating further contains Ni and Mn.

3. The coated steel sheet according to claim 2, wherein the zinc phosphate coating contains Mg at 0.5 to 10.0 mass %, Ni at 0.1 to 2.0 mass % and Mn at 0.5 to 8.0 mass %, and contents of Mn and Ni satisfy the following Formula (1):

$$[Ni]\times 7.6-10.9 \leqq [Mn] \leqq [Ni]\times 11.4 \quad (1)$$

wherein [Mn] is mass % of Mn, and [Ni] is mass % of Ni.

4. The coated steel sheet according to claim 3, wherein the zinc phosphate contains Mg at 2.0 to 7.0 mass %, Ni at 0.1 to 1.4 mass % and Mn at 0.5 to 5.0 mass %.

5. The coated steel sheet according to claim 4, wherein zinc phosphate in the zinc phosphate coating is granular crystals having a long side of less than 2.5 $\mu$m.

6. The coated steel sheet according to claim 1, wherein the orthophosphoric acid ester coating further contains Mg.

* * * * *